US006977991B1

(12) United States Patent
Neumeier et al.

(10) Patent No.: US 6,977,991 B1
(45) Date of Patent: Dec. 20, 2005

(54) COOLING ARRANGEMENT FOR AN X-RAY TUBE HAVING AN EXTERNAL ELECTRON BEAM DEFLECTOR

(75) Inventors: Ernst Neumeier, Aurachtal (DE); Hans Ströhlein, Nuremberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/756,084

(22) Filed: Jan. 13, 2004

(51) Int. Cl.[7] ..... H01J 35/10
(52) U.S. Cl. ..... 378/141; 378/137
(58) Field of Search ..... 378/127, 130, 378/141, 199, 200, 137

(56) References Cited

U.S. PATENT DOCUMENTS 5,689,542 A 11/1997 Lavering et al.
5,909,479 A 6/1999 Rother
6,055,294 A 4/2000 Foerst et al.
6,128,367 A 10/2000 Foerst et al.
6,249,569 B1 * 6/2001 Price et al. ..... 378/130
6,252,935 B1 * 6/2001 Styrnol et al. ..... 378/137
6,529,579 B1 3/2003 Richardson

FOREIGN PATENT DOCUMENTS

EP 0 009 946 4/1980

* cited by examiner

*Primary Examiner*—Edward J. Glick
*Assistant Examiner*—Chih-Cheng Glen Kao
(74) *Attorney, Agent, or Firm*—Schiff Hardin LLP

(57) ABSTRACT

A cooling arrangement for an X-ray tube of the type having a housing having an interior space in which the anode is disposed, and a projection in which the cathode is disposed, the projection being connected to the interior space by a neck region, includes channels for coolant flow formed by an electron beam detector that has a U-shape with legs that straddle the exterior of the neck region. Each leg of the electron beam deflector has a surface that faces an exterior corner of the housing formed by the projection, so as to form, in combination with the corner, a channel for coolant flow therethrough. A nozzle for discharging coolant can be provided at one end of each channel.

11 Claims, 3 Drawing Sheets

FIG. 2
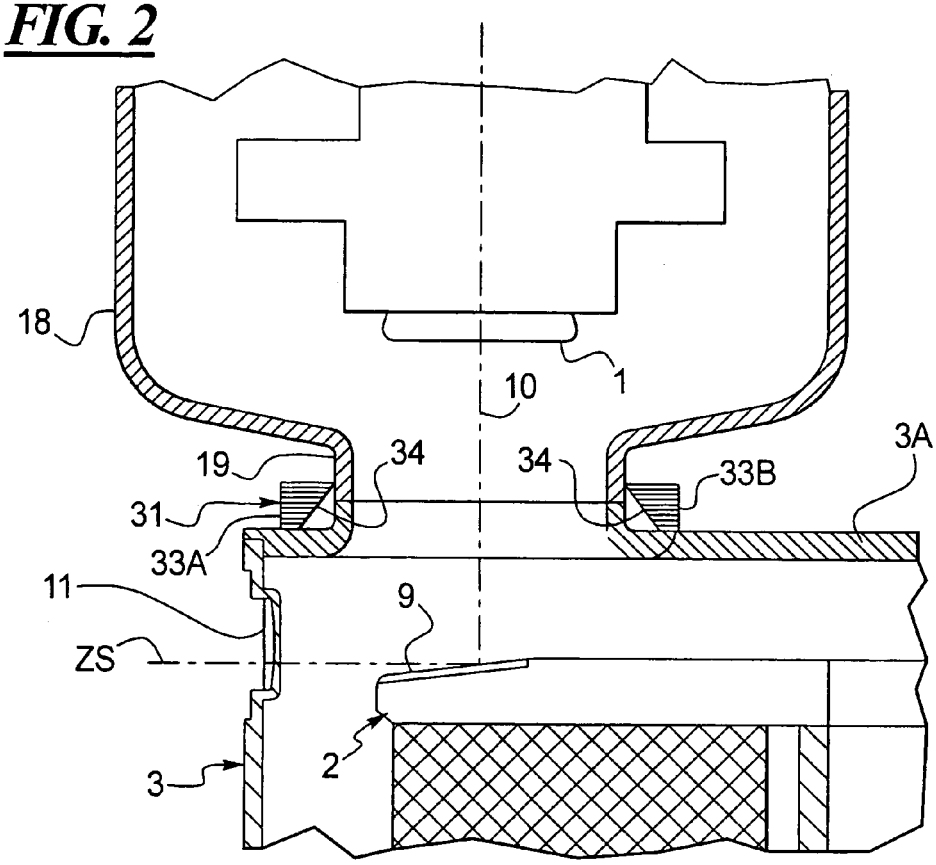
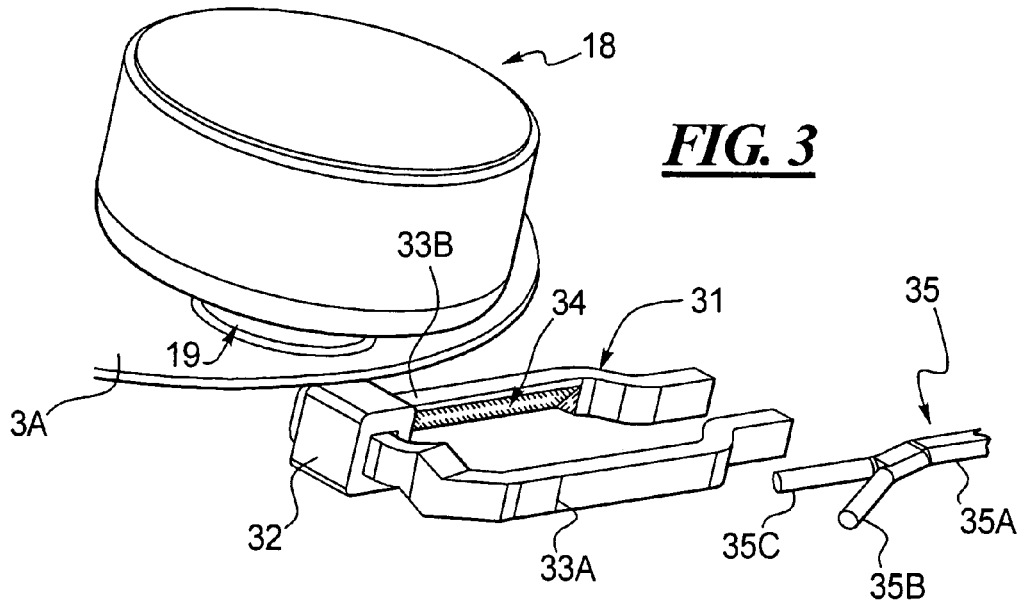
FIG. 3

FIG. 4
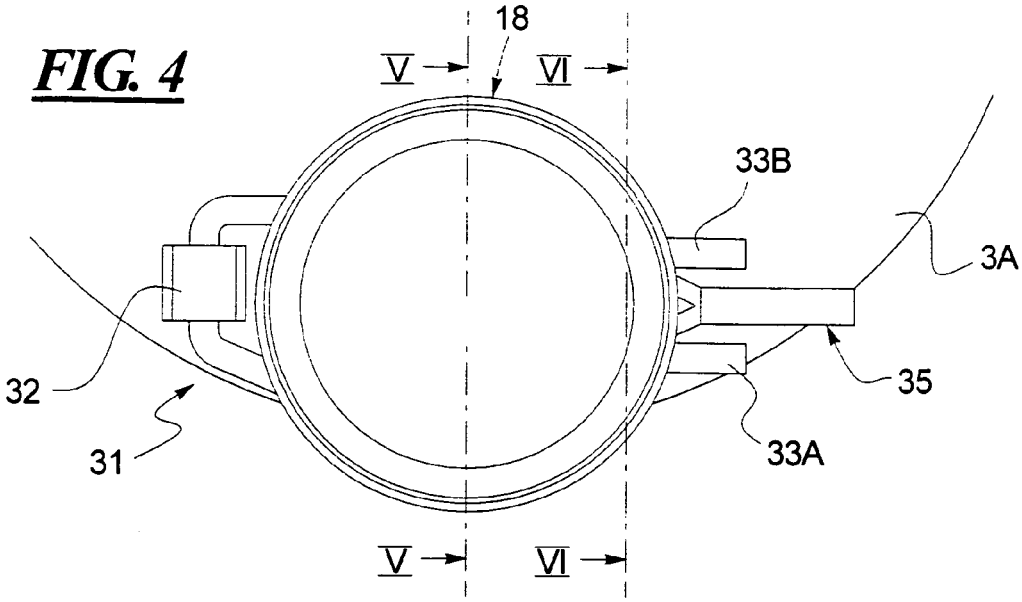
FIG. 5
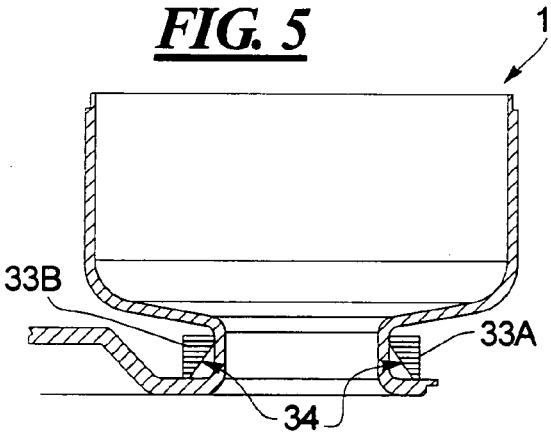
FIG. 6
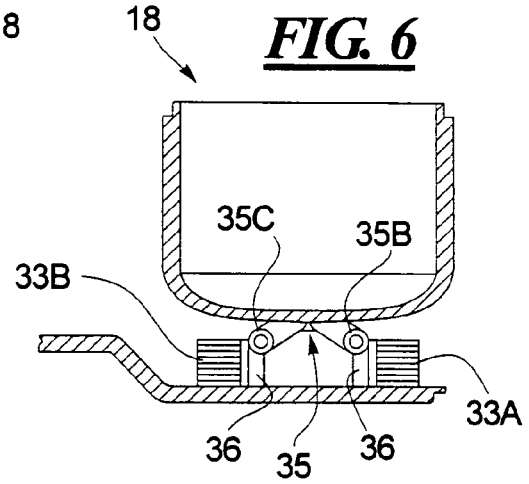
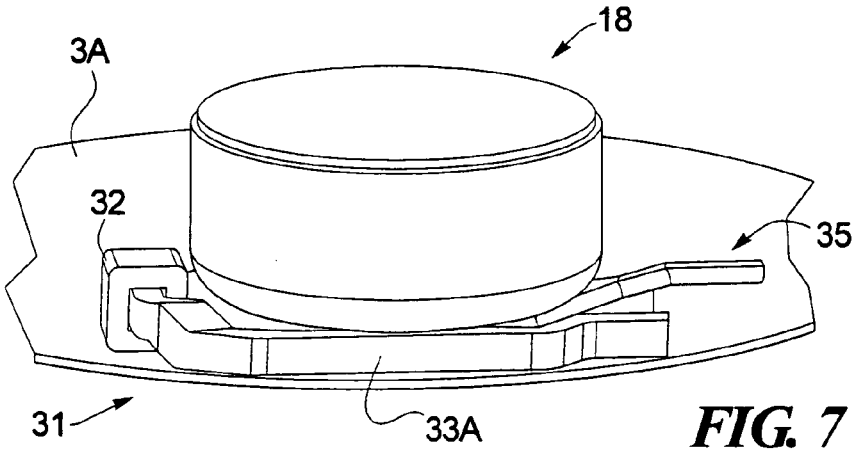
FIG. 7

COOLING ARRANGEMENT FOR AN X-RAY TUBE HAVING AN EXTERNAL ELECTRON BEAM DEFLECTOR

BACKGROUND OF THE INVENTION

1. Field of the Invention

The present invention is directed to an arrangement for cooling an X-ray tube of the type having an electron beam deflector that is disposed externally of the evacuated housing of the X-ray tube.

2. Description of the Prior Art

X-ray tubes, particularly rotating anode X-ray tubes, are known which have an evacuated housing having a large space in which the rotating anode is mounted, and a chamber, projecting from the large space and communicating therewith through a narrowed neck region of the evacuated housing. The cathode is disposed in the chamber, and the electron beam emitted by the cathode proceeds through the neck region into the larger region, where it strikes a surface of the rotating anode at a focus, from which X-rays are generated.

In such a rotating anode X-ray tube, a U-shaped electron beam deflector, typically in the form of an electromagnetic yoke is disposed at the exterior of the evacuated housing, with the two legs of the yoke straddling the exterior of the neck region. These legs conventionally are formed of stacked laminations in order to reduce eddy current losses, and have a rectangular or square cross-section. The electron beam deflector has a coil that is supplied with current to generate a magnetic field that interacts with the electron beam passing through the interior of the neck region, so as to selectively deflect the electron beam, thereby adjusting the position of the focus on the anode.

A rotating anode X-ray tube of this type is described in U.S. Pat. No. 5,909,479.

In order to increase the effectiveness of the interaction of the electron beam deflector with the electron beam, it is desirable to place the electron beam deflector, or at least the aforementioned legs thereof, as close as possible to the electron beam, given the physical constraints imposed by the size of the neck region of the evacuated housing. This reduces the volume in which the magnetic field generated by the electron beam deflector must be present, and thereby allows a lower control current to be supplied to the coil. The neck region of the evacuated housing, however, is unavoidably disposed at a location that is subject to back-scattered electrons arising from the electron beam striking the anode. The neck region of the housing, therefore, is severely heated during operation of the X-ray tube. The more that the neck region is constricted in order to permit the electron beam deflector to be disposed closer to the electron beam, the higher the density of the back-scattered electrons in the neck region, and therefore the higher the heating that ensues.

It is conventional for an X-ray tube of any type to be disposed in a protective radiator housing, which is filled with a coolant, such as insulating oil, that is circulated to dissipate heat during operation of the X-ray tube. In a rotating anode X-ray tube of the type described above, wherein the evacuated housing has a narrowed neck region wherein heating is particularly severe, it is desirable to augment the normal flow of the fluid coolant in the radiator housing to direct a specific portion of the coolant toward and around the neck region. One such arrangement is known from U.S. Pat. No. 6,529,579 wherein a channel, in which liquid coolant flows, is arranged to surround the neck region, this channel being in fluid communication with a coolant circulator (pump).

Not only does this known arrangement require rather complicated fabrication of the parts that form the coolant flow channel surrounding the neck region, but also this coolant flow channel must necessarily have a relatively small cross-section, because of the space confinements, and therefore the resistance to flow in this channel is high.

SUMMARY OF THE INVENTION

It is an object of the present invention to provide a cooling arrangement for an X-ray tube of the type having a narrowed neck region at which an electron beam deflector is disposed, wherein the cooling arrangement is relatively simple in construction and does not represent a high resistance to coolant flow.

The above object is achieved in accordance with the principles of the present invention in a cooling arrangement, and an X-ray source having such a cooling arrangement, wherein each of the two legs of the electromagnetic yoke that forms the electron beam deflector has a slanted surface that faces the exterior of the neck region at a corner that the neck region forms with the remainder of the housing, thereby forming a channel having a generally triangular cross section between the electron beam deflector and the exterior surface at the corner of the neck region. By departing from the conventional rectangular cross-section of the legs of the electromagnetic yoke, a passage for coolant flow is formed without the necessity of fabricating a separate flow channel component that must be fitted into the neck region in addition to the electromagnetic yoke. The electromagnetic yoke is simultaneously used for its conventional function of electron beam deflection, as well as being used to define a flow channel for coolant.

It is possible that the conventional circulation of coolant in the protective radiator housing, a portion of which will flow through the aforementioned channel formed by the electron beam deflector, can provide sufficient cooling under some circumstances. It is also possible to provide baffles or fins within the radiator housing to direct a specific portion of the flow through the channels formed by the electron beam deflector. In a preferred embodiment of the invention, however, a nozzle is disposed at one end of the channels formed by the electron beam deflector, and this nozzle is connected by tubing or a conduit to the circulator that is already present to circulate coolant in the radiator housing, or to a dedicated circulator (pump) that is specifically provided for circulating coolant through the channels formed by the electron beam deflector. The nozzle may have a V-shape, so that it has two nozzle openings that are respectively disposed next to the two channels respectively formed by the two legs of the electron beam deflector.

DESCRIPTION OF THE DRAWINGS

FIG. 2 is an enlarged sectional view of the neck region of the X-ray tube of FIG. 1, showing a portion of the cooling arrangement in accordance with the invention.

FIG. 3 is an exploded view of the exterior of the X-ray tube of FIG. 1, and the electron beam deflector and nozzle that are components of the inventive cooling arrangement.

FIG. 4 is a plan view from above of a portion of the X-ray tube of FIG. 1, showing the components of the cooling arrangement in place relative to the evacuated housing.

FIG. 5 is a sectional view taken along line V—V of FIG. 4.

FIG. 6 is a sectional view taken along VI—VI of FIG. 4.

FIG. 7 is a perspective view of the exterior of the upper portion of the X-ray tube of FIG. 1, with components of the cooling arrangement in accordance with the invention in place.

DESCRIPTION OF THE PREFERRED EMBODIMENTS

Figure 1:
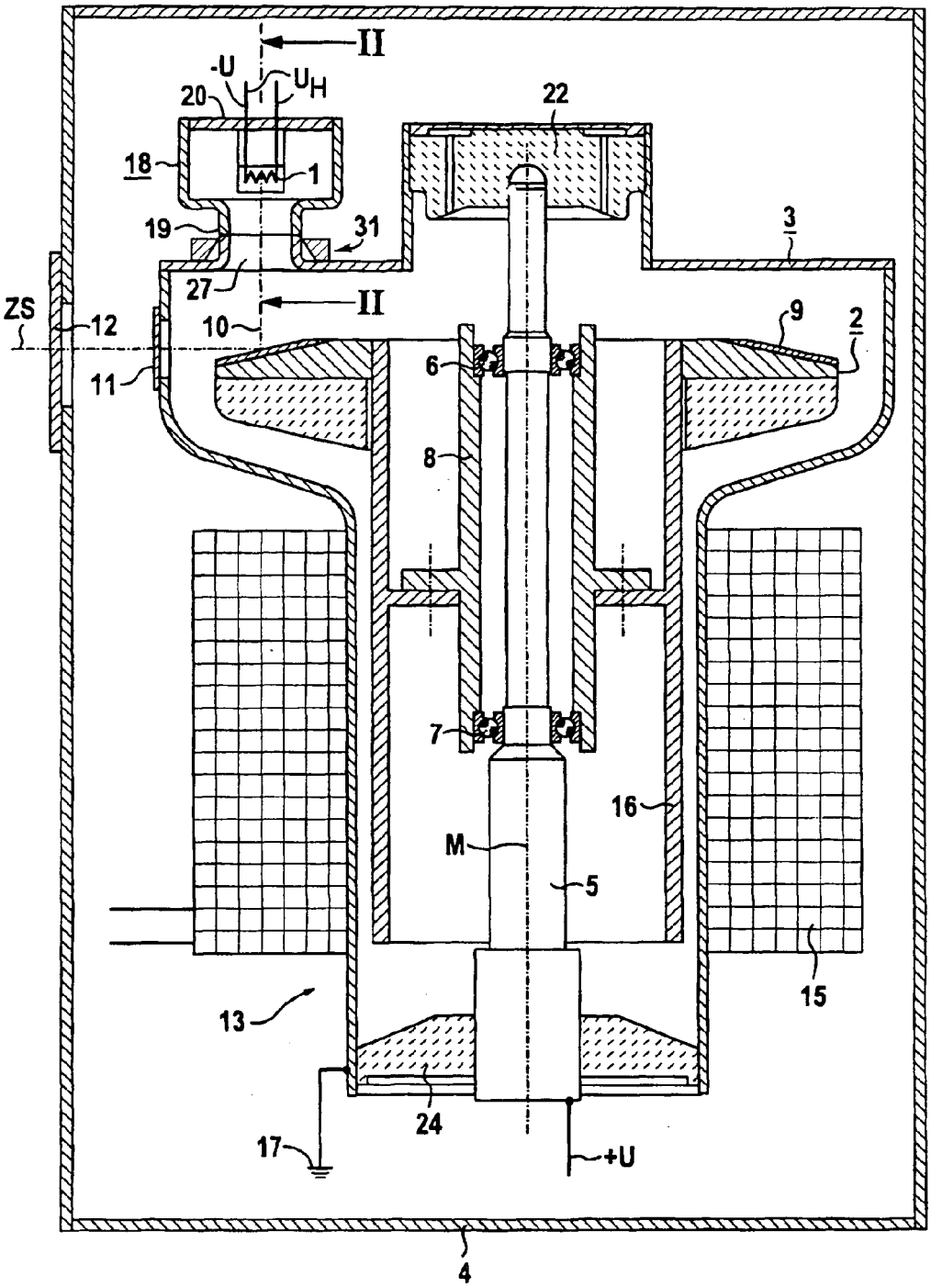
FIG. 1 is a sectional view through an X-ray tube, in the exemplary embodiment of a rotating anode X-ray tube, having a cooling arrangement constructed and operating in accordance with the principles of the present invention.

The X-ray tube according to FIG. 1 has a fixed cathode 1 and a rotating anode, generally referenced 2, that are arranged in a vacuum-tight evacuated housing 3 that is in turn disposed in a protective housing 4 filled with an electrically insulating, liquid cooling agent, for example insulating oil. The rotating anode 2 is rotatably mounted on a fixed shaft 5 in the vacuum housing 3 via two roller bearings 6 and 7 and a bearing sleeve 8.

The rotating anode 2, that is rotationally symmetric relative to the center axis M of the shaft 5, has an impact region that is provided with a layer 9 of tungsten-rhenium alloy, for example, that is struck by an electron beam 10 originating from the cathode 1 for the generation of X-rays. Only the center axis of the electron beam 10 is shown in FIG. 1, as a broken line. The interaction of the electron beam 10 with the layer 9 produces an X-ray beam, of which the central ray ZS is shown in FIG. 1. The X-ray beam exits through beam exit windows 11 and 12 respectively provided in the vacuum housing 3 and the protective housing 4, and which are disposed in alignment with each other.

An electric motor 13, fashioned as a squirrel-cage motor in this embodiment, is provided for the drive of the rotating anode 2. The motor 13 has a stator 15 that is slipped onto the exterior of the vacuum housing 3, and a rotor 16 disposed inside the vacuum housing 3, that is connected to the rotating anode 2 in a rotationally fixed manner.

The vacuum housing 3 is made of a metallic material except for an insulator 20 that supports the cathode 1 and two insulators 22 and 24, and is at ground potential 17. The vacuum housing 3 has a region surrounding a space or volume, provided for the acceptance of the rotating anode 2, to which a chamber 18, provided for the acceptance of the cathode 1, is connected via shaft-shaped housing section 19. The cathode 1 is attached to the chamber 18 via the insulator 20. The cathode 1 is therefore located in a special chamber of the vacuum housing 3, that is connected to the vacuum housing 3 via the shaft-shaped housing section 19.

The shaft 5 is at a positive high voltage +U for the rotating anode 2. The tube current therefore flows via the roller bearings 6 and 7.

One terminal of the cathode 1 is at a negative high voltage −U, as schematically indicated in FIG. 1. The filament voltage $U_H$ is across the two terminals of the cathode 1. The lines leading to the cathode 1, the shaft 5, the vacuum housing 3 and the stator 15 are in communication with a voltage supply (not shown) of a known type situated outside the protective housing 4, that supplies the necessary voltages for the operation of the X-ray tube. The X-ray tube according to FIG. 1 thus is of a type known as a two-pole X-ray tube.

As shown in FIG. 1, the electron beam 10 that originates from the cathode 1 propagates through the shaft-shaped housing section 19 to the rotating anode 2. The housing section 19, therefore, limits a diaphragm aperture 27. The dimensions of the diaphragm aperture 27 are selected so that they do no significantly exceed the dimensions that are necessary for an unimpeded passage of the electron beam 10.

At least the chamber 18, the shaft-shaped housing section 19, and the upper wall 3A (see FIGS. 2–6), and preferably all parts of the vacuum housing 3, are made of non-magnetic material, for example stainless steel, and limit an annular space that is radially open to the exterior of the vacuum housing 3. An electromagnet 32, schematically indicated in FIG. 3, is arranged in this annular space, and serves as a deflector 31 to generate a magnetic deflecting field for the electron beam 10. The electron beam 10 is deflected perpendicularly to the plane of the drawing of FIG. 1.

As shown in FIGS. 1, 2 and 3, the electron beam deflector 31 has two legs 33A and 33B that straddle the neck region 19 of the evacuated housing 3. Each of the legs 33A and 33B has a slanted surface 34 that faces the exterior of the neck region 19. Each slanted surface 34, in combination with the exterior surface of the neck region 19 facing it, forms a channel having opposite ends that are open to the exterior, and thus are in fluid communication with the interior of the protective housing for, in which liquid coolant, such as insulating oil, is present. Each of the channels has a generally triangular cross-section, and allows coolant to flow therethrough to carry away heat that is generated in the neck region 19 during operation of the X-ray tube.

As shown in FIGS. 3, 4, 6 and 7, promotion of coolant flow through these channels can be achieved by the use of a nozzle 35 disposed at one end of the channels formed by the respective surfaces 34. The nozzle 35 has a main conduit 35A that leads to a circulator for the coolant, which may be the primary circulator that is used to circulate coolant within the protective housing 4, or may be a dedicated circulator (pump) solely for circulating fluid through the channels formed by the surfaces 34. The main conduit 35A branches into two nozzle conduits 35B and 35C which are placed directly adjacent to the openings at one end of the respective conduits formed by the surfaces 34. This is best seen in the sectional view of FIG. 6, wherein supports 36 for the nozzle conduits 35B and 35C also can be seen. In that sectional view, the legs 33A and 33B of the electron beam deflector 31 still have a rectangular cross-section, since the section along line VI—VI of FIG. 4 that is shown in FIG. 6 is taken just at the beginning of the channels. As shown in the sectional view of FIG. 5, taken approximately at the center of the projection 18, the generally triangular shaped channels have been formed by the slanted surfaces 34. FIG. 7 shows the arrangement of the nozzle 35 at one end of these channels.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray source comprising:

an X-ray tube having an evacuated housing containing an interior space and having a housing projection forming a chamber in communication with said interior space via a neck region of said housing, said neck region forming a corner having an exterior surface at an exterior of said housing;

a cathode disposed in said chamber and an anode disposed in said interior space, said cathode emitting an electron beam that proceeds through said neck region and strikes said anode at a focus to generate X-rays from said focus; and an electron beam deflector disposed at an exterior of said neck region of said housing for generating a magnetic field that interacts with said electron beam to deflect said electron beam to adjust a position of said focus on said anode, said electron beam deflector having a U-shape with two legs straddling said neck region at said corner, each of said legs having a leg surface facing and contacting said exterior surface of said corner, and each leg surface in combination with said exterior surface of said corner forming a channel adapted to allow a flow of coolant therethrough.

2. An X-ray source as claimed in claim 1 wherein each of said channels has a channel opening, and wherein said X-ray source comprises a nozzle having at least one nozzle opening disposed adjacent to said channel openings for directing a flow of coolant through said channel openings and through said channels.

3. An X-ray source as claimed in claim 2 wherein said nozzle has a V-shape and has two nozzle openings respectively disposed adjacent said channel openings.

4. An X-ray source as claimed in claim 1 wherein the respective surfaces of said legs facing said corner are flat, and define a generally triangular cross-section for said channels in combination with said corner.

5. An X-ray source as claimed in claim 1 wherein each leg surface in combination with said exterior surface of said corner forms a straight channel.

6. An X-ray source as claimed in claim 5 wherein said straight channel defines a straight flowpath for said coolant entirely disposed substantially perpendicularly to said electron beam.

7. A method for cooling an X-ray tube having an evacuated housing with a projection, through which an electron beam proceeds, forming a corner having an exterior surface at an exterior of the housing and having an electron beam deflector disposed at an exterior of the housing for generating a magnetic field that interacts with the electron beam to deflect the electron beam, said electron beam deflector having a U-shape with two legs each having a leg surface, comprising the steps of:

forming a channel for a coolant by placing the respective legs of said electron beam deflector directly over said exterior surface of said corner to contact each leg surface with the exterior surface of said corner; and conducting coolant through said channel.

8. A method as claimed in claim 7 wherein the step of conducting coolant through each of said two channels comprises disposing a nozzle having a V-shape at an end of each of said two channels, and discharging coolant from said nozzle through each of said two channels.

9. A method as claimed in claim 7 wherein the step of conducting coolant through said channel comprises disposing a nozzle having a nozzle opening at one end of said channel, and discharging coolant from said nozzle through said channel.

10. A method as claimed in claim 7 comprising forming a straight channel by combining each leg surface with said exterior surface of said corner.

11. A method as claimed in claim 10 further comprising conducting coolant through said straight channel in a flowpath entirely disposed substantially perpendicularly to said electron beam.

* * * * *